United States Patent [19]

Gigli

[11] Patent Number: 4,540,303

[45] Date of Patent: Sep. 10, 1985

[54] PEN NIB WITH POWDER-GASPHASE DIFFUSION LAYER

[75] Inventor: Giuseppe Gigli, Lodi, Italy

[73] Assignee: Standardgraph Zeichengerate GmbH, Fed. Rep. of Germany

[21] Appl. No.: 493,966

[22] Filed: May 12, 1983

[30] Foreign Application Priority Data

May 13, 1982 [DE] Fed. Rep. of Germany ... 8213929[U]

[51] Int. Cl.[3] ..... B43K 1/06

[52] U.S. Cl. ..... 401/258; 401/265; 401/292

[58] Field of Search ..... 401/258, 259, 260, 292, 401/215, 265

[56] References Cited

U.S. PATENT DOCUMENTS

| | | | |
|---|---|---|---|
| Re. 30,626 | 5/1981 | Kaplan et al. | 401/215 |
| 3,025,835 | 3/1962 | Race | 401/215 |
| 3,558,235 | 1/1971 | Bok | 401/258 |
| 3,859,190 | 1/1975 | Koelichen, Jr. | 401/258 X |

FOREIGN PATENT DOCUMENTS

| | | | |
|---|---|---|---|
| 7115555 | 10/1972 | Fed. Rep. of Germany . | |
| 2135780 | 5/1973 | Fed. Rep. of Germany | 401/259 |
| 2605873 | 2/1982 | Fed. Rep. of Germany . | |
| 1051009 | 12/1966 | United Kingdom | 401/258 |

*Primary Examiner*—Steven A. Bratlie

*Attorney, Agent, or Firm*—Ostrolenk, Faber, Gerb & Soffen

[57] ABSTRACT

A nib having an ink tube of chrome nickel steel, and also a cleaning wire which likewise consists of chrome nickel steel, is subjected to surface hardening by means of a boride process.

12 Claims, 4 Drawing Figures

Figure 1:
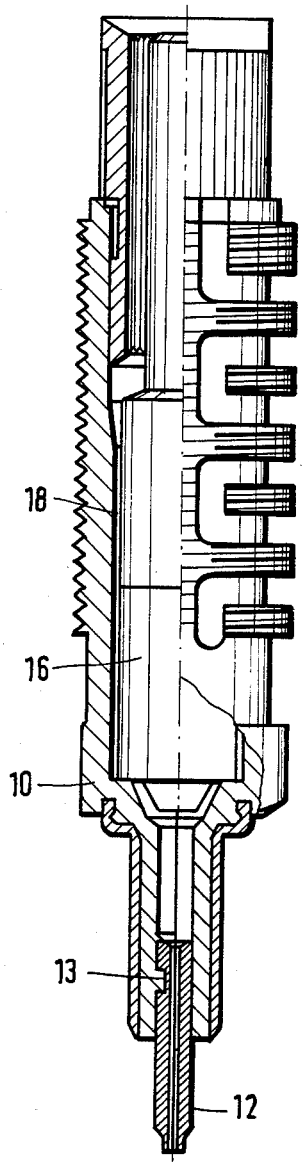

Fig. 3
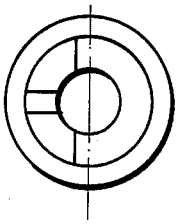
Fig. 4
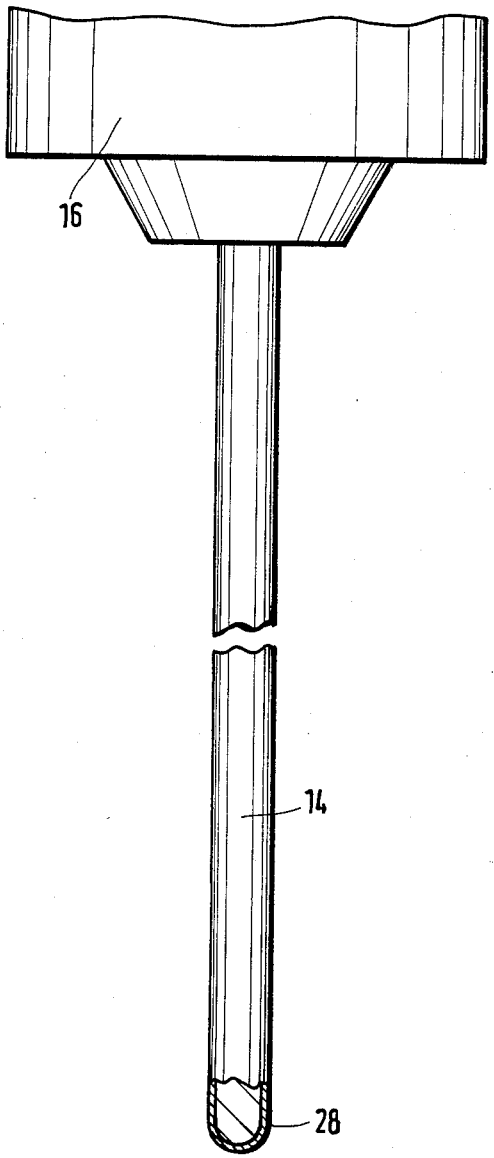
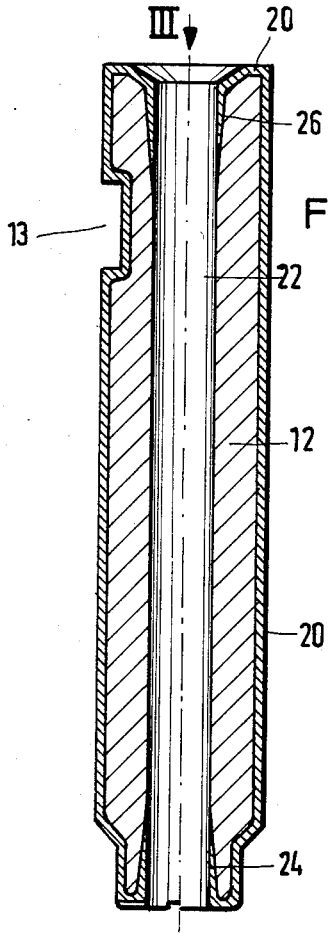
Fig. 2

PEN NIB WITH POWDER-GASPHASE DIFFUSION LAYER

The invention relates to a nib for an ink pen, the nib comprising an ink tube and a cleaning wire guided in the inside of the tube, wherein the end of the cleaning wire projects by a predetermined distance beyond the front end of the ink tube when its fall weight sits on the annular abutment shoulder of the nib, and wherein at least the end surfaces of the ink tube and/or cleaning wire which run on the writing surface are provided with a surface layer made mechanically resistant by a hardening process.

The ink tubes of such nibs are subjected to high frictional loading at their annular end surface which comes into contact with the writing surface, particularly when drawing on a synthetic foil. The asperities (roughness) of the writing surface which are always present act as an abrasive and bring about non-uniform wear which leads to a damaging effect on the flow of ink and an impaired script or drawing with non-even line width.

During writing or drawing the end surface of the front end of the cleaning wire, which is enclosed by the ink tube, frictionally contacts the writing surface and is thus likewise subjected to wear. As a result the length of the cleaning wire is shortened to a higher degree than the length of the ink tube so that the danger exists that the cleaning wire can no longer be advanced sufficiently far through the ink tube in order to ensure reliable cleaning. Accurate dimensioning of the length of the cleaning wire is however important because a wire which projects too far will bend or break off.

For this reason one endeavors to make the surfaces of the ink tube and/or cleaning wire which run on the writing surface as mechanically resistant as possible.

It is known to build ink tubes of sintered hard metal into the nibs. These nibs have excellent abrasive resistance. Their disadvantage lies in the extremely high price brought about by the expensive manufacturing method. Accordingly, ink tubes and cleaning wires of chrome nickel steel which have been subjected to surface treatments to form a wear-resistant layer are mostly used for cost reasons.

It is known from DE-GM No. 71 15 555 to manufacture this wear-resistant surface layer by a cathode sputtering process.

Furthermore, a method for increasing the abrasive resistance of ink tubes of refined steel or nickel metal alloys is known from DE-PS No. 26 05 873 in which the workpieces are carbonized in accordance with the CVD-process (chemical vapor deposition) in a gaseous carbon atmosphere using heat and pressure and then subsequently cooled in an inert atmosphere.

This method can admittedly be carried out relatively inexpensively, however the abrasive resistance which can be produced is limited and the life is significantly lower than with the more expensive ink tubes of hard metal.

The invention is based on the problem of providing a nib with an ink tube and cleaning wire which has wear-resistant sliding surfaces and the mechanical resistance of which is the same or close to that of an ink tube of hard metal, but which is significantly cheaper to manufacture.

This object is satisfied in accordance with the invention by providing a surface layer in the form of a powder-gasphase diffusion layer.

The writing tube and cleaning wires of such nibs can be manufactured from a relatively inexpensive initial material of stainless steel and can be hardened in a simple and inexpensive manner because the addition of boron using a powder or granulate containing boron, or a paste, can be carried out without the exclusion of air and without the use of a protective gas.

Ink tubes constructed in this manner are particularly suitable for use in automatic computer controlled drawing machines or writing apparatus and tests have shown that ink tubes in accordance with the invention ensure trouble-free writing or drawing over a surprisingly long period even when using rough foils.

Further advantageous embodiments of the invention are set forth in the subordinate claims.

An embodiment of the invention will now be described by way of example in the following with reference to the drawings which show:

FIG. 1 a sectional view of a nib constructed in accordance with the invention;

FIG. 2 a section of the ink tube of the nib of FIG. 1 but to a larger scale;

FIG. 3 a view of the ink tube in the direction of the arrow III of FIG. 2; and FIG. 4 a partial view of the cleaning wire anchored in a drop weight to the same scale as in FIG. 3.

The nib of FIG. 1 has an ink tube 12 which is injection molded into a synthetic body 10. In FIGS. 1 and 2 an ink tube having a peripherally extending anchoring tube 13 is shown to the left of the axis whereas the embodiment to the right of the axis has a smooth ink tube. The nib has a cleaning wire 14 which is guided in the inner opening of the ink tube and which is secured in a drop weight 16 which slides with play in a cylindrical recess 18 of the synthetic body 10.

As can be seen from FIG. 2 the outer cylindrical peripheral surface of the ink tube 12 and the lower annular end face which runs on the writing surface, and also the upper ring surface, are provided with a hardened surface layer 20. The surface layer may have substantially the same layer thickness over the entire outer surface of ink tube 12. The thickness may be between 1 and 10 μm and in particular may be between 2 and 5 μm. This surface layer continues in the internal bore 22 of the ink tube in the form of inwardly tapering surface portions 24 and 26. These transition portions 24 and 26 are brought about by the hardening process because the surface hardening of the ink tube consisting of stainless steel takes place in a powder, or granulate, or paste containing a boron compound which can only penetrate the bore 22 to a limited extent. A hardening of this internal bore is actually not essential. An ink tube and a cleaning wire of chrome nickel steel may be used, in which case the surface layers 20, 28 will comprise metal borides such as chrome boride, iron boride and nickel boride. A higher resistance to abrasion through the writing surface is ensured by the surface layer at the lower annular end face. The surface layer on the outer side protects the ink tube against wear as it slides along rulers and other guide rails.

As can be seen from FIG. 4, the cleaning wire is also provided with a hardened surface layer 28 which provides the wire with the desired resistance to abrasion. In this way it is ensured that the tip of the cleaning wire 14 always projects by a predetermined amount beyond the front annular end face of the ink tube. The cleaning wire 14 may have a small diameter, and the surface layer may extend only over the end surface of the cleaning wire.

The member forming the cleaning wire 14 may be made of tungsten, so that the surface layer 28 comprises tungsten boride.

The surface layer 20 or 28 is hardened by a boride process using higher temperatures with the result that boride compounds are created in the surface layer which have excellent resistance to abrasion and good resistance to oxidation.

I claim:

1. A nib for ink pens, comprising:

an ink tube having opposite upper and lower ends and an inside opening defined therein between the upper and lower ends, the ink tube further having a lower end surface at the lower end for contacting a writing surface; and a cleaning wire guidably positioned in the inside opening of the ink tube and having a wire end surface for projecting by a predetermined distance beyond the lower end surface of the ink tube for contacting the writing surface; at least one of the lower end surface of the ink tube and the wire end surface of the cleaning wire comprising a powder-gasphase diffusion layer for hardening the end surface and for providing mechanical resistance.

2. A nib in accordance with claim 1 wherein the diffusion layer contains compounds of the boron group, the boron group being group III in the periodic table of the elements.

3. A nib in accordance with claim 2, wherein the ink tube and cleaning wire each comprise chrome nickel steel, the diffusion layer comprising a boride layer.

4. A nib in accordance with claim 3 wherein the diffusion layer comprises metal boride.

5. A nib in accordance with claim 1 wherein the cleaning wire comprises tungsten.

6. A nib in accordance with claim 5 wherein the diffusion layer of the cleaning wire comprises tungsten boride.

7. A nib in accordance with claim 1 wherein the ink tube further has an outer surface including the lower end surface, the entire outer surface of the ink tube comprising the diffusion layer, the diffusion layer extending over the entire outer surface with substantially the same layer thickness.

8. A nib in accordance with claim 7 wherein the ink tube has an inner surface facing the inner opening, the inner surface comprising upper and lower diffusion layer portions adjacent the upper and lower ends of the ink tube, respectively, the thickness of each of the diffusion layer portions reducing from the respective end towards the inner opening.

9. A nib in accordance with claim 7 wherein the layer thickness of the diffusion layer is between 1 and 10 $\mu$m.

10. A nib in accordance with claim 1 wherein the cleaning wire has a small diameter, the diffusion layer extending only over the wire end surface of the cleaning wire.

11. A nib in accordance with claim 1 wherein the writing tube has a peripherally extending anchoring groove defined therein for being injection moulded into a synthetic body of an ink pen.

12. A nib in accordance with claim 9 in which the layer thickness of the diffusion layer is between 2 and 5 $\mu$m.

* * * * *